US005325794A

United States Patent [19]

Hontani

[11] Patent Number: 5,325,794

[45] Date of Patent: Jul. 5, 1994

[54] DISPLAY TABLE

[75] Inventor: Kenro Hontani, Hiroshima, Japan

[73] Assignee: Daiki Shoji Kabushiki Kaisha, Hiroshima, Japan

[21] Appl. No.: 941,664

[22] Filed: Sep. 8, 1992

Related U.S. Application Data

[63] Continuation-in-part of Ser. No. 676,791, Mar. 28, 1991, abandoned.

[30] Foreign Application Priority Data

Jun. 26, 1992 [JP] Japan ..... 4-193392

[51] Int. Cl.[5] ..... A47B 9/00

[52] U.S. Cl. ..... 108/117; 108/115

[58] Field of Search ..... 108/116, 117, 145, 115; 248/423, 421

[56] References Cited

U.S. PATENT DOCUMENTS 4,143,602 3/1979 Brunn ..... 108/117

4,273,306 6/1981 Chang ..... 108/145

*Primary Examiner*—Kenneth J. Dorner

*Assistant Examiner*—Gerald A. Anderson

*Attorney, Agent, or Firm*—Koda and Androlia

[57] ABSTRACT

A display table used in exhibition sights, etc. including a table top and four foldable legs attached to the table top. The upper ends of the legs can slide along the side edges of the table and between the center and the corners of the table top. By sliding the legs and thus changing the angles between the legs and table top, the height of the table is changed. At a desired height, the legs are secured to the table top via bolts.

5 Claims, 4 Drawing Sheets

DISPLAY TABLE

This is a continuation-in-part of application Ser. No. 676,791, filed Mar. 28, 1991, now abandoned.

BACKGROUND OF THE INVENTION

1. Field of the Invention

The present invention relates to a height adjustable display table.

2. Prior Art

Conventionally, when exhibitions, shows, etc., are held, the place of exhibition is prepared in advance based upon arrangement plans, etc. which enhance the effectiveness of displays and special characteristics of the items displayed. In the preparation process, various utensils, equipment, materials and tools, etc. are brought into the exhibition place in large numbers, and "human wave" tactics are used to set up the exhibition place in a short period of time.

The display tables are no exception. A "terraced display" system having lower displays in front and higher displays in the back is employed in order to utilize the available space most efficiently and to attract the attention of exhibition-goers. Accordingly, various types of tables of different heights are brought in and set up and skilled personnel are called for assembling such tables.

However, the supervision of the loading, transportation, unloading, installation and removal etc., of a large number of tables of various types requires considerable labor and complicated record-keeping. The preparation of such display tables for the actual display items also requires considerable labor, with multi-level displays, etc., being used (from the standpoint of display style) in order to utilize the available space efficiently, and in order to attract the attention of exhibition-goers. Such multi-level displays may be set up by bringing in various types of tables of different heights. However, an excess or shortage of tables of specified heights often occur at exhibition locations. In such cases, the required tables are constructed on an emergency basis by skilled personnel, otherwise additional tables are brought in from the outside. This results in an excessive and wasteful expenditure of funds and labor.

SUMMARY OF THE INVENTION

In order to eliminate the above-described drawbacks, the present invention provides a display table of unique structure wherein a table is provide with four legs, each comprising a crank bar and a rod. Crank bars are pivotally connected to four corners of the under surface of the table top, and the rods each having wheels at the lower end and a slider at the upper end are pivotally coupled to the lower end of each crank bar. The rod is slidably coupled to the under surface of the table top. The four legs are thus mounted to the table top. In addition, a stopper means is installed to each slider so as to secure the slider at any desired position under the table top, thus fixing the table height.

DETAILED DESCRIPTION OF THE INVENTION

Figure 1:
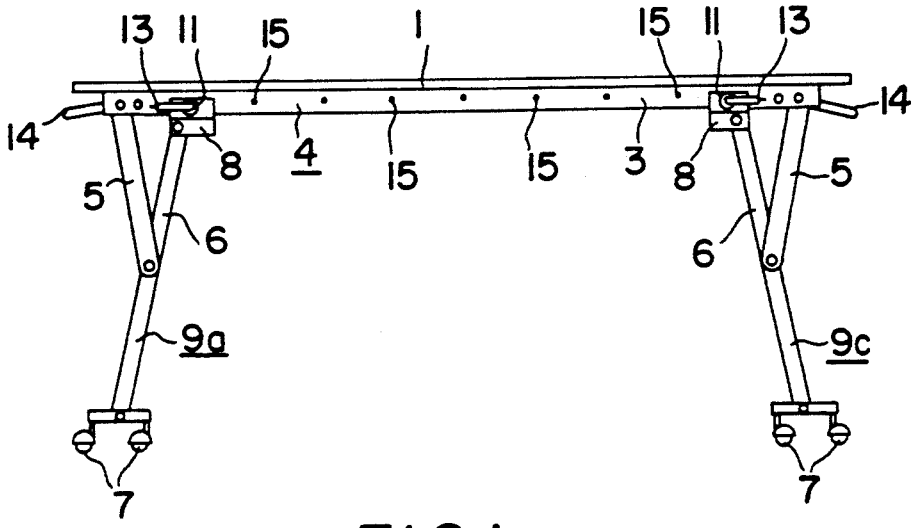
FIG. 1 is a front view of the display table according to the present invention.
Figure 2:
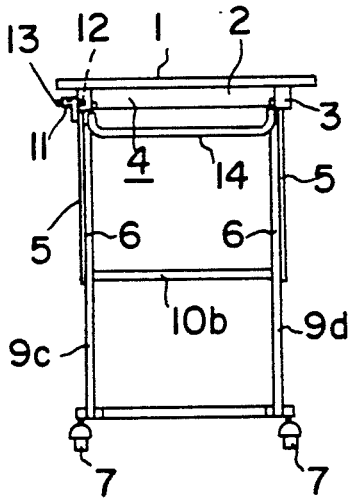
FIG. 2 is a side view thereof.

One embodiment of the present invention will be described with reference to the accompanying drawings.

A table top 1 is provided with a supporting frame 4 underneath. The frame 4 comprises a pair of girder members 2 and a pair of beams 3. The beams 3 are provided with engaging holes 15. The same number of engaging holes 15 are provided on the two beams 3 at regular intervals.

Four foldable legs 9*a* through 9*d* are mounted to the frame 4. Each leg comprises a rod 6 and crank bar 5. The upper end of the crank bar 5 is pivotally coupled to the corners of frame 4, and the lower end of the crank bar 5 is rotatably connected to the middle portion of the rod 6. The lower end of the rod 6 is provided with casters 7, and the upper end thereof has a slider 8. The slider 8 is slidable along the beam 3 of the frame 4.

Leg 9*a* is connected to leg 9*b* via a first brace 10*a*, and leg 9*c* is connected to leg 9*d* via a second brace 10*b*. Pairs of legs (9*a* and 9*b*, 9*c* and 9*d*) facing each other are thus formed.

Each of the four sliders 8 are coupled to the corresponding beam 3 by a bolt 12. A stopper means 11 is installed on the side surface of the slider 8. The stopper means 11 controls the distance the slider 8 moves. Each stopper means 11 has a bolt 12. By inserting and retracting the bolt 12 in and out of the engaging hole 15, the slider is allowed to move or be fixed positionally. The inserting and retracting operation of the bolts 12 can be accomplished remotely by handles 14 via wire cables 13.

A plurality of casters 7 are used, as shown in the drawings, so as to let the weight of the table be distributed evenly on the floor and to receive a reaction force. However, it is possible to use only a single caster at the lower end of each rod 6.

The legs constructed as described above form a slider crank mechanism, so that foldable table legs are formed, and the height of the table can be freely adjusted according to the angle between the legs 9 and frame 3.

Figure 3:
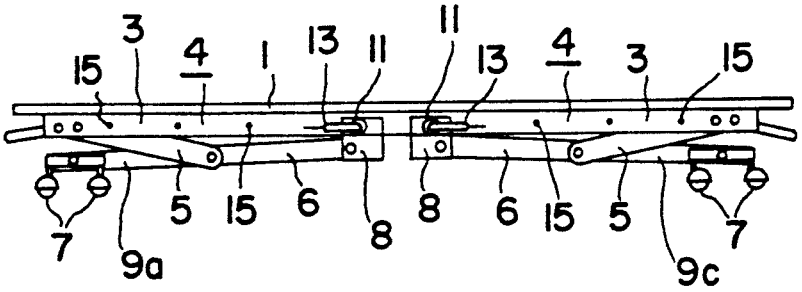
FIG. 3 is a front view of the folded display table.
Figure 4:
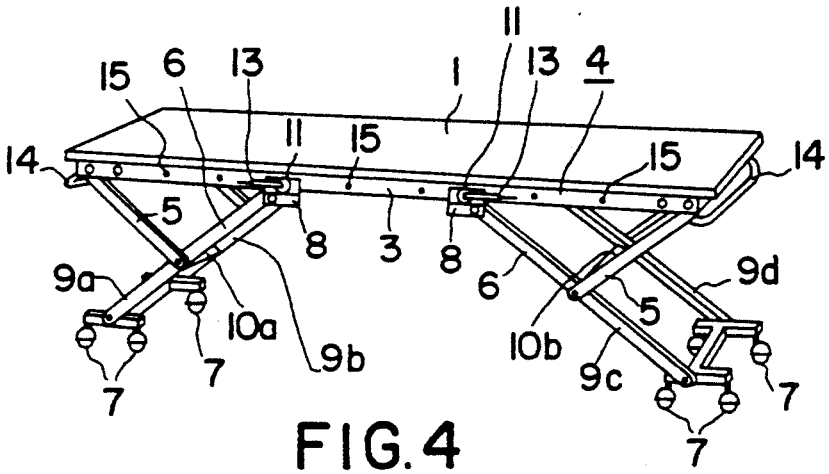
FIG. 4 is a perspective view thereof.

In operation, as first seen in FIG. 3, when the table top 1 is set at its lowest height, the sliders 8 are moved to the farthest positions from the four corners of the frame 4, and links which make up the slider crank mechanism are at the lowest limit of their folding motion. In other words, the links are folded flat and the undersurface of the table top 1 is almost parallel to the rods 6. The casters 7 are brought to the closest position to the undersurface of the table top 1.

When, on the other hand, the table top 1 is set at its maximum height (see FIG. 1), the sliders 8 are brought to the positions closest to the four corners of the frame 4, and the links which make up the slider crank mechanism are at the upper limit of their folding motion. In other words, the links are at the maximum angles with respect to the undersurface of the table top 1. The rods 6 are almost at right angles against the table top 1, and casters 7 are at the positions farthest from the undersurface of the table top 1.

In either case, the logs are positionally fixed by means of the stopper means 11.

Within the range between the maximum and minimum limits of the folding motion, the height of the table top 1 can be continuously set in accordance with the angles formed by the respective links with respect to the undersurface of the table top 1.

The height of the table top 1 can be changed as desired within the range in which the links can open and close at its maximum range. In this case, a means is necessary for fixing the folding motion of the links at a desired angle relative to the table surface.

The stopper mechanism 11 includes the bolt 12 which is caused to project by a spring. Thus, the bolt 12 engages with one of engaging holes 15 which are formed in each beam 3. The table top 1 is thus fixed at any desired height. This engagement position of the rod 6 and frame 4 can be changed by merely pulling out the bolts 12 by overcoming the force of the springs. If the bolts 12 are connected to the handles 14 via wire cables 13, the fixing and changing of the table height is accomplished by remote control.

Figure 5:
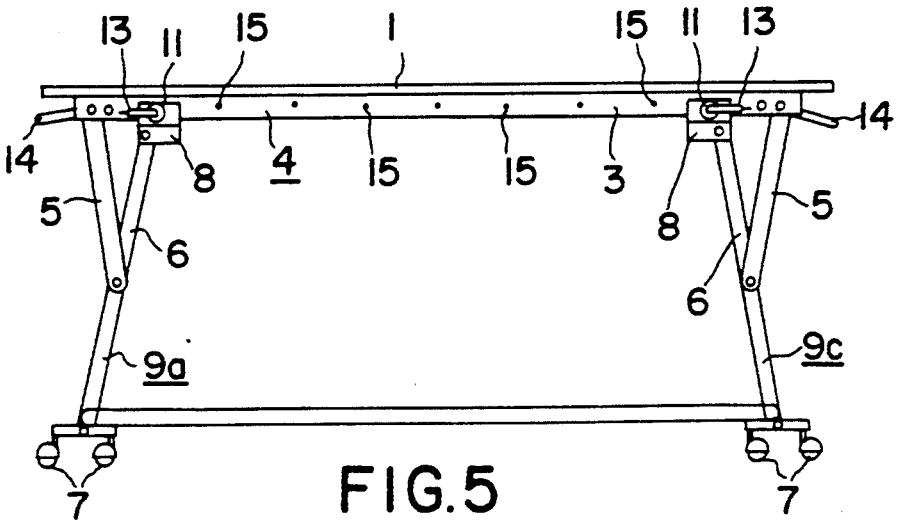
FIG. 5 is a front view of the table of the present invention with a bar installed between the legs.

As seen from FIG. 5, when a stationery bar is installed between the facing legs 9*a* and 9*c* (also 9*b* and 9*d*), the table can be further stable on the floor and can stay even.

Figure 6:
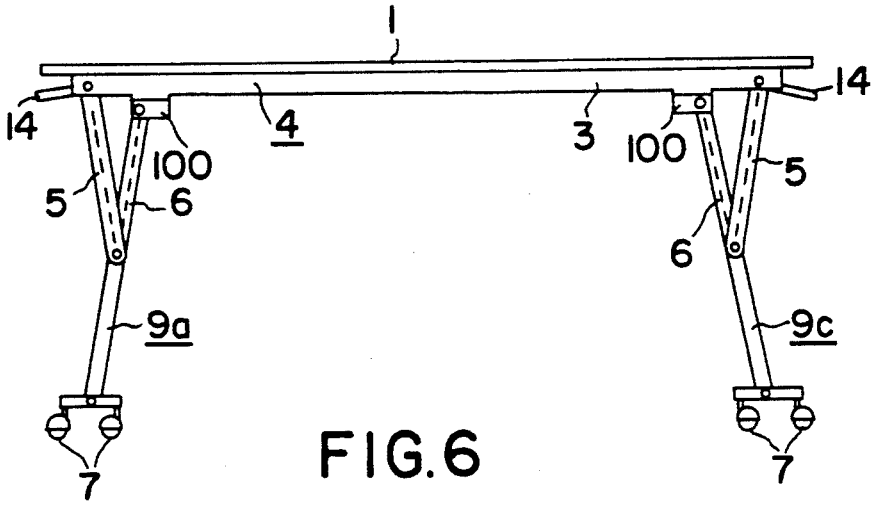
FIG. 6 is a front view of the table of the present invention.

FIG. 6 shows the second embodiment of the present invention. In this embodiment, the stopper mechanism 100 is different from that of the table shown in FIGS. 1 through 5. More specifically, the bolt 12 of the stopper mechanism 11 of the first embodiment is horizontally inserted in the engaging hole 15. On the contrary, a bolt member of the table shown in FIG. 6 is vertically inserted in the engaging hole of the beam.

A detailed description of the stopper mechanism will be described below with reference to FIG. 7.

A sliding member 101, which has an approximately "I" shaped cross section, is fixed to a movable housing 102, and the sliding member 101 is movably held in a slit 116*a* provided inside the "C" shaped beam 116.

The bolt or latch means 120 is comprised of a bolt member 107, a spring 109, a pair of rings 106 and 108, a cylindrical member 105, and a rod member 110. The spring 109 and rings 106 and 108 are installed in the cylindrical member 105. The ring 106, which is connected to the bolt member 107, is slidably moved along the inner surface of the cylindrical member 105.

The ring 108 is placed on the top surface of the movable housing 102 to support the end of the spring 109. Therefore, the bolt member 107 is urged by the spring 109 so as to protrude to one of engaging holes 117. The engaging holes 117 are provided on each one of the beams 116 at regular intervals.

The rod member 110 is connected to the bottom end of the bolt member 107, and the both ends of the rod member 110 are jutted out to the outer surfaces of the movable housing 102 through slits 103 and supported by washers 111, respectively, so that the rod member 110 is prevented from falling.

Consequently, the rod member 110 can be moved up and down along the slit 103, and the movement of the rod member 110 causes the bolt member 107 to move vertically.

A wedge member 112 has a tapered portion 113 and is slidably inserted into a space which is between the inner surface of the top plate 102*a* of the movable housing 102 and the rod member 110 so that the tapered portion 113 of the wedge member 112 is a top surface of the rod member 110. The sliding movement of the wedge member 112 can be made by using a rail as a guide (not shown).

The wedge member 112 has a through hole 112*a*, and the wire cable 114 is connected to this through hole 112*a*. A spring 115 is also installed in the wedge member 112. Therefore, when the wire cable 114 pulls the wedge member 112 in the direction indicated by arrow A, the end portion of the spring 115 comes into contact with the bolt member 107. When the wire cable 114 is released, the wedge member 112 moves in the direction indicated by arrow B by the spring 115, so that the wedge member 112 returns to its initial position.

Figure 7:
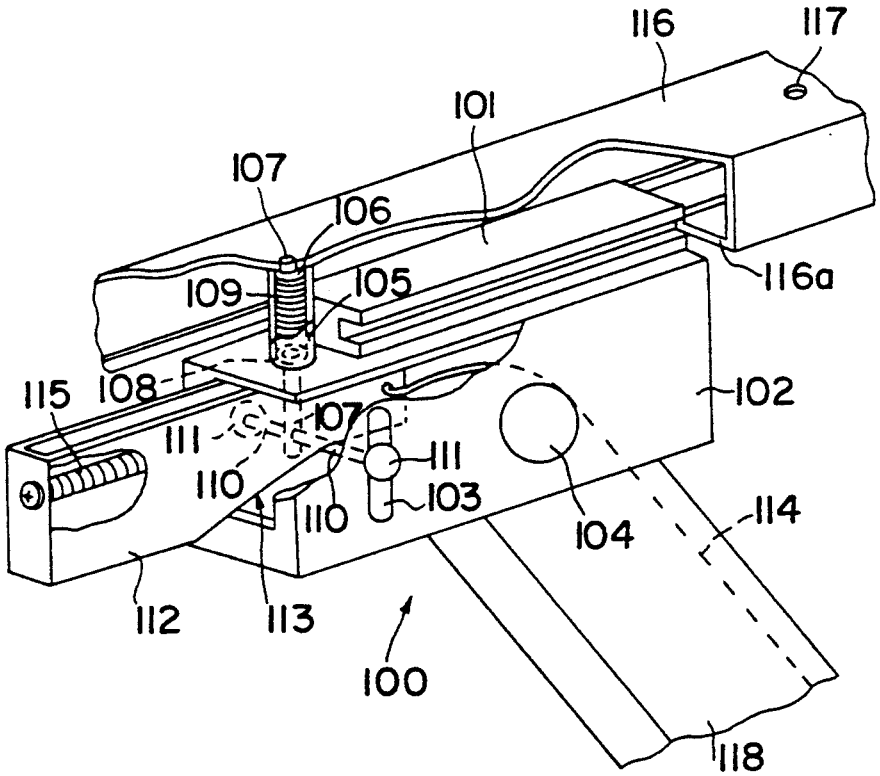
FIG. 7 is a perspective view of the stopper mechanism of the present invention.

In operation, when the bolt member 107 is engaged with one of the engaging holes 117, the wedge member 112 is positioned as shown in FIG. 7 by the spring 115 which urges the wedge member 112 in the direction indicated by arrow B. At this time, the tapered portion 113 of the wedge member 112 is located and in contact with the rod member 110.

When the wire cable 114 is pulled by operating the handles 14 (shown in FIG. 1) in the same manner as the wire cable 13 in the first embodiment, the wedge member 112 is moved in the direction indicated by arrow A. As a result, the tapered portion 113 of the wedge member 112 pushes the rod member 110 to move down as the wedge member 112 is pulled into the movable housing 102, and the bolt member 107 is also moved down with the rod member 110. Therefore, the bolt member 107 is disengaged from the engaging hole 117, and the stopper mechanism 100 is released.

After the bolt member 107 is disengaged from the engaging hole 117, the movable housing 102, which is attached with the rod or leg 118 is moved along the slit 116*a* of the beam 116. If the operation of the handle is discontinued, and the wire cable 114 is released, the wedge member 112 is moved in the direction indicated by arrow B and positioned at its original location. Thus, the bolt member 107 is urged by the spring 115 so as to protrude from the cylindrical member 105, and the end portion of the bolt member 107 is kept in contact with the inner surface of the beam 116 until the bolt member 107 is engaged with the engaging hole 117.

In other words, until the movable housing 102 is moved to a desired position and the bolt member 107 is engaged with the engaging hole 117, the rod member 110 is located with a distance from the tapered portion 113 of the wedge member 112. Therefore, when the bolt member 107 is engaged with the engaging hole 117, such an engaging movement of the bolt member 107 does not move the wire cable or the handle (not shown).

Figure 8:
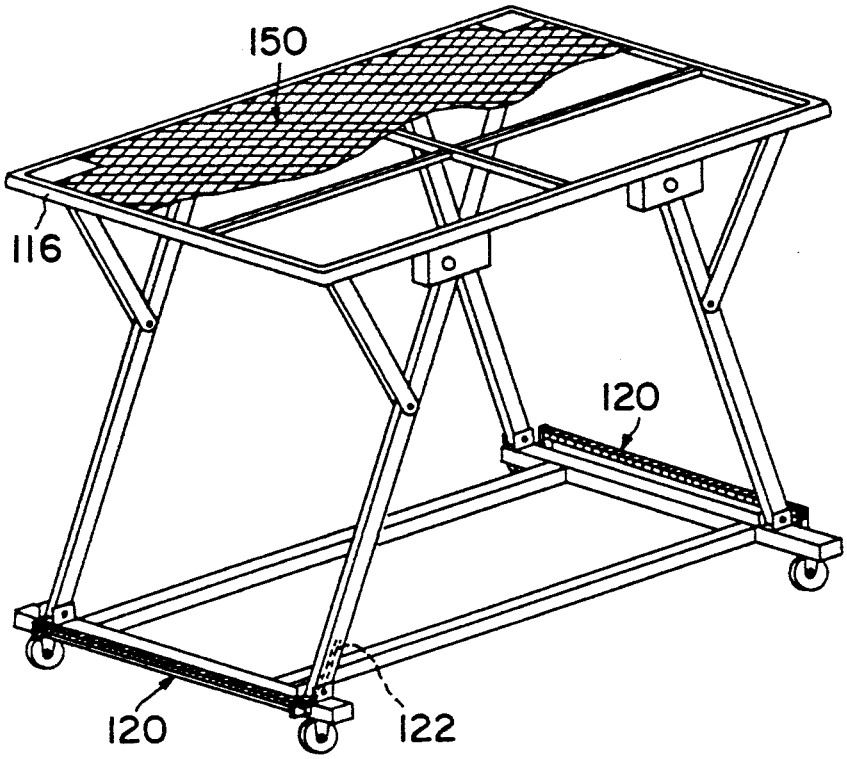
FIG. 8 is a perspective view of the table of the present invention.

FIG. 8 shows the third embodiment of the present invention. Instead of using the table top, a net 150 is provided on a beam 116. This type of the table is lighter than the table of the first and second embodiment since the net 150 is used as a top member. Therefore, it is easy to carry the table.

Furthermore, an operating bar 120 is fixed on a brace 121, and a wire cable 122 is connected to the operating bar 120. The other end of the wire cable 122 is connected to the wedge member (not shown in FIG. 8, but refer to FIG. 6). Therefore, when adjusting the height of the table, the bolt member is disengaged by stepping on the operating bar 120.

Figure 9:
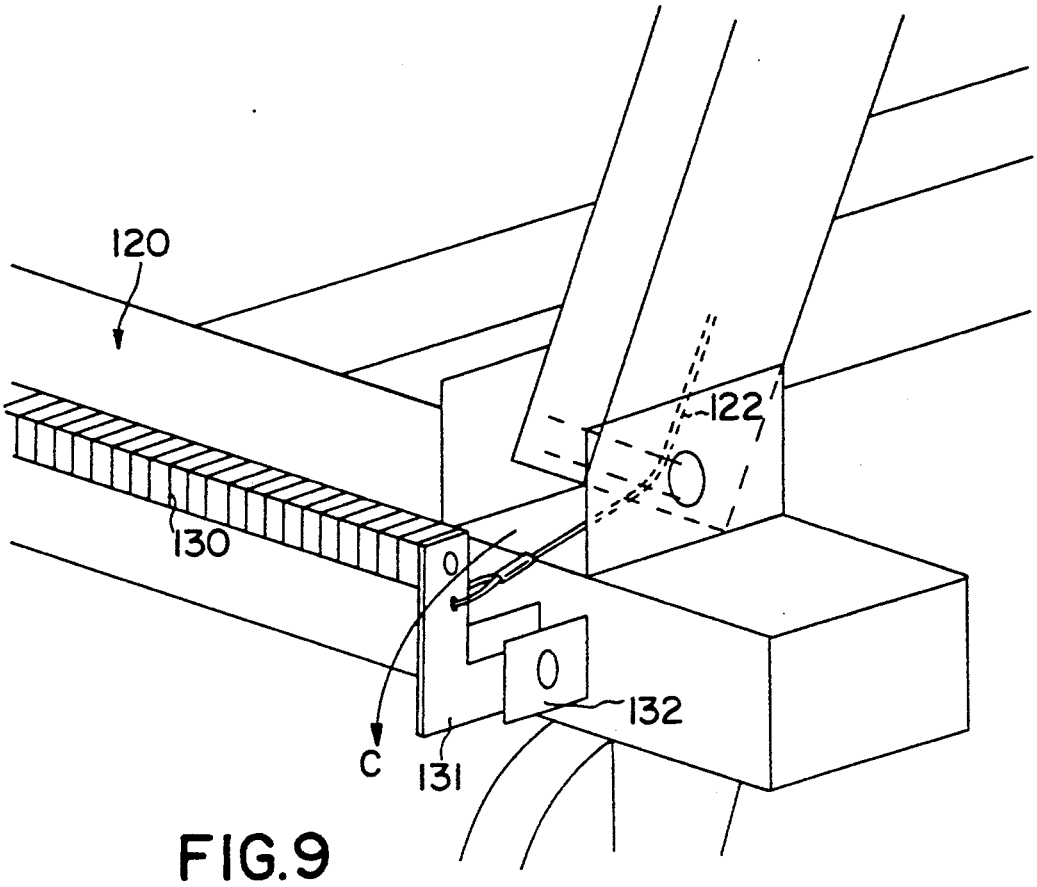
FIG. 9 is an enlarged perspective view of the operating bar.

FIG. 9 shows a detail of the operating bar 120. The operating bar 120 is comprised of a bar 130, an L-shaped member 131, and a supporting plate 132. The bar 130 is mounted on the top portion of the L-shaped member 132, and the other end of the L-shaped member 131 is rotatably supported by a shaft 133 on the supporting plate 132. The cable wire 122 connected to the wedge member of the stopper mechanism (not shown) is attached to the top portion of the L-shaped member 131.

When the bar 130 is stepped on by a foot of an operator, the bar 130 is rotated about the shaft 133 in the direction indicated by arrow C. As a result, the wire cable 122 is pulled, and the bolt member (not shown in FIG. 8) is disengaged from the engaging hole.

As seen from the above description, according to the present invention, a single display table can provide any desired height. Accordingly, there is no need to spend time checking the respective numbers of various types of display tables. In addition, the display table of the present invention can be handled easily, and multi-level (different heights) displays using the table can be prepared in a short period of time. Accordingly, unnecessary workers can be eliminated.

According to the present invention, when multi-level displays installed facing one way is necessary to be reversed in its direction, there is no need to replace the tables. According to the present invention, the orientation of the table can easily be changed by changing the height of the tables (such as bringing the highest table down to the lowest, and changing the lowest table to the highest). Since various types of display items can be balanced at various heights, rooms at higher spaces can be utilized effectively.

The present invention has further advantages. Since the tables can be folded to the same compact size, packing and loading can be done very easily.

I claim:

1. A display table comprising:

a table top;

a supporting frame fixed to an under surface of said table top, said frame comprising a pair of girder members and a pair of beams, and each of said beams being provided with engaging holes and a slit;

four legs coupled to said supporting frame, each leg comprising a crank bar and a rod so that an upper end of said crank bar is pivotally connected to one of four corners of said frame and a lower end of said crank bar is rotatably connected to a middle of said rod;

a sliding member movably held in said slit provided in each of said beams, said sliding member having an approximately "I" shaped cross section;

a stopper mechanism comprising a movable housing, a bolt, and a wedge member, said movable housing being mounted to said sliding member, said wedge member being movably provided in said movable housing so that a tapered portion of said wedge member is in contact with a rod member of said bolt, and said bolt is movable in the vertical direction by an operating means so as to engage one of said engaging holes.

2. A display table according to claim 1, wherein a stationery bar is mounted between two legs.

3. A display table according to claim 1, wherein said table top is made of a net.

4. A display table according to claim 1, wherein said operating means is a handle connected to said wedge member by a wire cable.

5. A display table according to claim 1, wherein said operating means is a step bar connected to said wedge member by a wire cable.

* * * * *